US006464493B2

(12) United States Patent
Polino et al.

(10) Patent No.: US 6,464,493 B2
(45) Date of Patent: Oct. 15, 2002

(54) MULTI-AXIS ROTARY SEAL SYSTEM

(75) Inventors: Brian A. Polino, Clarence; Douglas E. Ludwig, Depew; Carl H. Vander Weide, Lockport; David M. Bencic, Batavia; Edgard Matrak, Tonawanda, all of NY (US)

(73) Assignee: Harper International Corp., Lancaster, NY (US)

( * ) Notice: Subject to any disclaimer, the term of this patent is extended or adjusted under 35 U.S.C. 154(b) by 0 days.

(21) Appl. No.: 09/923,939

(22) Filed: Aug. 7, 2001

(65) Prior Publication Data

US 2002/0022209 A1 Feb. 21, 2002

Related U.S. Application Data

(60) Provisional application No. 60/224,431, filed on Aug. 11, 2000.

(51) Int. Cl.[7] ..... F27B 7/24
(52) U.S. Cl. ..... 432/115; 277/590
(58) Field of Search ..... 432/103, 115; 277/358, 390, 391, 590

(56) References Cited

U.S. PATENT DOCUMENTS 3,584,885 A * 6/1971 Oberndorfer ..... 277/82
4,193,756 A * 3/1980 Leon ..... 432/115
4,295,824 A * 10/1981 Wens ..... 432/115
5,383,672 A * 1/1995 Cornelius ..... 432/115

* cited by examiner

*Primary Examiner*—Gregory Wilson
(74) *Attorney, Agent, or Firm*—Jaeckle Fleischmann & Mugel, LLP

(57) ABSTRACT

A multi-axis rotary seal system to provide a gas-tight seal between a stationary hood and the end of a rotating tube kiln comprises a stationary hood positioned at the end of the rotary tube and having extended therefrom, a fully flexible bellows attached at the other end to a structural ring which, in turn, is attached to a graphite ring, slidably pressed against a flange on the rotary tube to form an atmospheric seal. The structural ring is held to the stationary hood by multi-axis supports that allow movement of the ring in three axial directions. In operation, during expansion and contraction of the rotating tube and eccentricities of motion, the integrity of the slidable seal formed by the graphite ring against the mating surface of the tube flange, is maintained by a biasing device pressing the graphite ring and the tube flange together in slidable engagement.

22 Claims, 4 Drawing Sheets

MULTI-AXIS ROTARY SEAL SYSTEM

CROSS-REFERENCE TO RELATED APPLICATIONS

This application claims the benefit of U.S. Provisional Patent Application No. 60/224,431, filed Aug. 11, 2000, entitled Multi-Axis Rotary Seal System. The disclosure of this application is totally incorporated herein by reference.

FIELD OF THE INVENTION

The present invention relates to seals used, for example, between rotating and stationary members. More specifically, the present invention is useful for maintaining a tight connective means, such as for example, a seal that prevents or minimizes the escape of substances such as gases between for example, a rotary tube kiln and a stationary hood and in embodiments that may prevent or minimize substances such as air from entering the kiln, or a similar apparatus.

BACKGROUND OF THE INVENTION AND PRIOR ART

Rotary tube kilns, also referred to as rotary tube furnaces, are commonly operated at elevated temperatures and with contained atmospheres for the treatment of materials being processed therein. In some uses, the leakage of materials, such as gas from the kiln is hazardous and may be detrimental to its operation and to the health and safety of individuals working with the kiln. For example, the processing of some materials requires a reducing atmosphere, such as hydrogen or other reducing gas or gaseous mixtures. The escape of such gases from the kiln or similar apparatus or device can adversely affect the environment and may create a hazard. Furthermore, the infiltration of air from the surrounding atmosphere into the rotary tube kiln may be detrimental to the process, or even hazardous for example, creating an explosive hazard. These and other disadvantages are avoided or minimized with the present invention.

It is known to employ graphite rings as seals at the ends of rotary tubes to prevent the leakage of gas. However, the thermal expansion of the rotary tube along the longitudinal axis of the tube at elevated temperatures may exert considerable horizontal axial pressure against the graphite ring seal, and other kiln components, causing motor drag and premature wear. Furthermore, repeated expansion and contraction associated with kiln temperature cycles can result in the development of gas leaks around the seal. The integrity of the seal, such as a graphite seal, is affected not only by the linear expansion and contraction of the rotary tube along the horizontal (longitudinal) axis, but also by eccentricities of rotational motion. These and other disadvantages are avoided or minimized with the present invention.

U.S. Pat. No. 6,042,370 issued to Vander Weide discloses a graphite rotary tube furnace for operation in controlled atmospheres at temperature of 1,500° to 2,800°, and which tube comprises a generally horizontal rotatable graphite tube slidably supported on water-cooled split ring graphite bearings. An atmospheric seal is maintained with the aid of a flexible gas tight seal comprising graphite sealing rings slidably pressed against either or both sides of a drive plate with one or more flexible bellows to impart a positive sealing spring type force. The bellows and the drive plate are preferably comprised of stainless steel to withstand the conditions of operation of the furnace. This patent also discloses a gas inlet provided within graphite sealing rings for the transmission of an inert gas to maintain a positive pressure around the drive plate and the outside of the graphite tube in the region of the product entrance end of the furnace.

U.S. Pat. No. 5,551,870 issued to Gale discloses a rotating seal for a rotary drum seal including a rotating seal member welded about the drum near each of its ends, each sealing against a rotationally stationary seal member joined with the associated kiln end hood through a flexible gas tight bellows. The stationary seal rides on a pair of rollers each bearing upon a track, preventing its rotation. The bellows accommodates longitudinal expansion and contraction of the drum. Hanging weights are used with pulley wheels and flexible cables to urge the non-rotating members against the rotating members with unvarying force.

U.S. Pat. No. 5,406,579 issued to Vallomy discloses a dynamic seal for limiting the passage of a gas such as air through an opening, by providing a sealing chamber in advance of the entrance to the low pressure chamber having a large plenum with a variable speed exhaust blower in its upper portion, and a grate situated in its lower portion for access of air to the plenum. The blower speed is responsive to differential pressure measurements taken in the low pressure chamber and immediately adjacent the exterior of the low pressure chamber. Upstream of the plenum are one or more mechanical seals or flexible baffles which contact the top of the solid charge material and ride over it as the solid material passes beneath the mechanical seal.

Atmospheric seal systems for use between rotating and stationary members such as between a rotating tube kiln and a stationary hood, are disclosed in co-pending application entitled ATMOSPHERIC SEAL ASSEMBLY FOR A ROTATING VESSEL, filed of even date herewith, the disclosure of which is totally incorporated herein by reference The disclosures of each of the above U.S. Patents are incorporated herein by reference in their entireties. In embodiments of the present invention the appropriate components and processes of the aforementioned patents may be selected for the seal arrangement and apparatus of the present invention.

SUMMARY OF THE INVENTION

It is an object of the present invention to provide a system for atmospheric sealing of a rotary tube furnace during operation.

It is a further object of the present invention to provide a seal for a rotary tube furnace that will compensate for the longitudinal and radial thermal expansion and contraction of the rotary tube as a result of temperature cycles, as well as for eccentricities of motion, while maintaining the integrity of the seal.

Additionally, it is an object of the present invention to prevent or minimize the unwanted entry or escape of substances, such as hazardous gases from device and apparatus, such as rotary tube kilns and the like.

Further, it is another object of the present invention to minimize or avoid excessive forces to be exerted on kiln seals which force can cause motor drag and premature wear of the seal and wherein there can be selected flexible, inclusive of fully flexible bellows which bellows have for example, a force of zero pounds per sq. inch when compressed, to maintain a permanent or substantially permanent seal. A related object of the present invention is to provide a multi-axis mechanical support system for flexible bellows and to provide an insulated shroud or protectant around a tube end directly under the bellows to prevent radiant heat generated from the bellows adversely affecting the life tie of the bellows.

The present invention provides a multi-axis rotary seal system for rotary tubes and in aspects thereof the present invention is directed to a seal arrangement comprising:

a structural ring;

at least two multi-axis supports attached to and supporting the structural ring which, in turn, holds, or is attached to hold a seal ring, such as a graphite ring, in sealing engagement with an end of a kiln tube;

a fully flexible bellows having first and second ends, the first end attached to the structural ring, the second end attached to a stationary hood; and a biasing device applying force to the structural ring in a direction such that the structural ring biases the seal ring against the end of the kiln tube, thereby maintaining a substantially gas-tight seal between the seal ring and the end of the kiln tube during expansions and contractions of the kiln tube.

Typically, from two to about five multi-axis supports, preferably two, are positioned at approximately equal intervals around the circumference of the structural ring. Each multi-axis support comprises:

a bracket attached to the stationary hood;

a first shaft attached to the bracket, a longitudinal axis of the first shaft being substantially perpendicular to a longitudinal axis of a rotary tube furnace;

a second shaft having a longitudinal axis substantially parallel to the longitudinal axis of the rotary tube furnace and connected at one end to the first shaft through a bushing mounted around the first shaft, the bushing allowing limited rotation of the second shaft about the longitudinal axis of the first shaft;

a linear bearing at another end of the second shaft;

a spherical bearing mounted about the linear bearing and supporting the structural ring.

The linear bearing allows movement of the structural ring along the second shaft and the spherical bearing allows movement of the structural ring about an axis substantially perpendicular to the longitudinal axes of both the first and second shaft.

In a preferred embodiment of the seal arrangement of the present invention, the end of the kiln tube includes a flange suitable for slidable engagement with a seal ring such as a graphite ring.

In one embodiment of the present invention, the biasing device comprises at least two pneumatic cylinders, each attached at one end to the structural ring and at the other end to the stationary hood. Typically, two to twelve or more pneumatic cylinders may be employed depending on the circumference of the rotary tube kiln.

In another embodiment of the present invention, the biasing device comprises a spring-loaded cam-follower clamping device that provides a clamping pressure on the flange extending from the wall of a rotating vessel, such as a rotary tube kiln, and a stationary seal ring, such as a graphite ring, to provide a seal between the rotating vessel and the stationary sealing ring. The cam-follower clamping device comprises a cam-follower which, in use, is rotatably pressed against a side of the rotating flange opposite another side of the flange that slidably engages the seal ring; and an opposing spring which presses against a surface of the structural ring opposite another surface of the structural ring that is attached to the stationary seal ring, maintaining the rotating flange and stationary seal ring in slidable engagement and providing a vapor tight seal at this juncture of the sealing ring and flange.

In another embodiment of the invention, an insulating thermal shroud is positioned concentrically within the flexible bellows covering the end of the rotary tube and protecting the flexible bellows from heat.

The rotary tube kiln may be comprised of various materials depending, for example, on the temperatures and other conditions, to which it may be subjected and the nature of the particulate and gaseous materials with which it may be used. Typically, the rotary tube and flange, and structural ring, are comprised of a heat and chemically resistant material, such as stainless steel or high temperature alloy. Other examples of materials include plastic, aluminum, coated plastics, and various metals, such as carbon steel, and the like. The seal ring is preferably a graphite ring. However, depending on conditions of use, such as temperature, other low friction materials, such as polytetrafluoroethylene, or the like, may be used. The perpendicularity of the tube flange and the sealability of its surface with the graphite ring may be assured by machining the mating surface of the flange, that is, the surface that contacts the stationary graphite ring to form a seal. The graphite allows the tube to rotate with little drag and maintains a tight or substantially tight seal, such as a seal that will prevent gas escape from the kiln. The flange may be at the end of the rotary tube, but will typically be positioned a short distance back from the end. The end of the tube will then pass through the graphite ring, steel ring, and bellows, and enter the exit hood. As the kiln temperature increases, the rotating tube will expand in length and the tube flange will push against the graphite ring, compressing the bellows. The multi-axis support compensates for expansion and contraction of the rotating tube kiln, due to temperature changes, and eccentricities of motion of the rotating tube kiln while providing support for the structural ring and attached seal ring. As a result, the bellows does not have to provide support to the structural ring and seal ring and thus may be made of an extremely flexible material. The belllows employed in the present system may be a flexible bellows. In one preferred embodiment, the bellows may be preferably a fully flexible bellows made, for example, of flexible material, such as an elastomeric material like rubber or plastic, or even of thin metal. The material need not provide the bellows with enough strength to support itself. The thermal shroud, protecting the flexible bellows from heat, may be made of various insulating materials such as ceramic fibers or the like.

The multi-axis rotary seal system of the present invention may be installed at either or both ends of a rotary tube kiln.

DETAILED DESCRIPTION OF THE INVENTION

Figure 1:
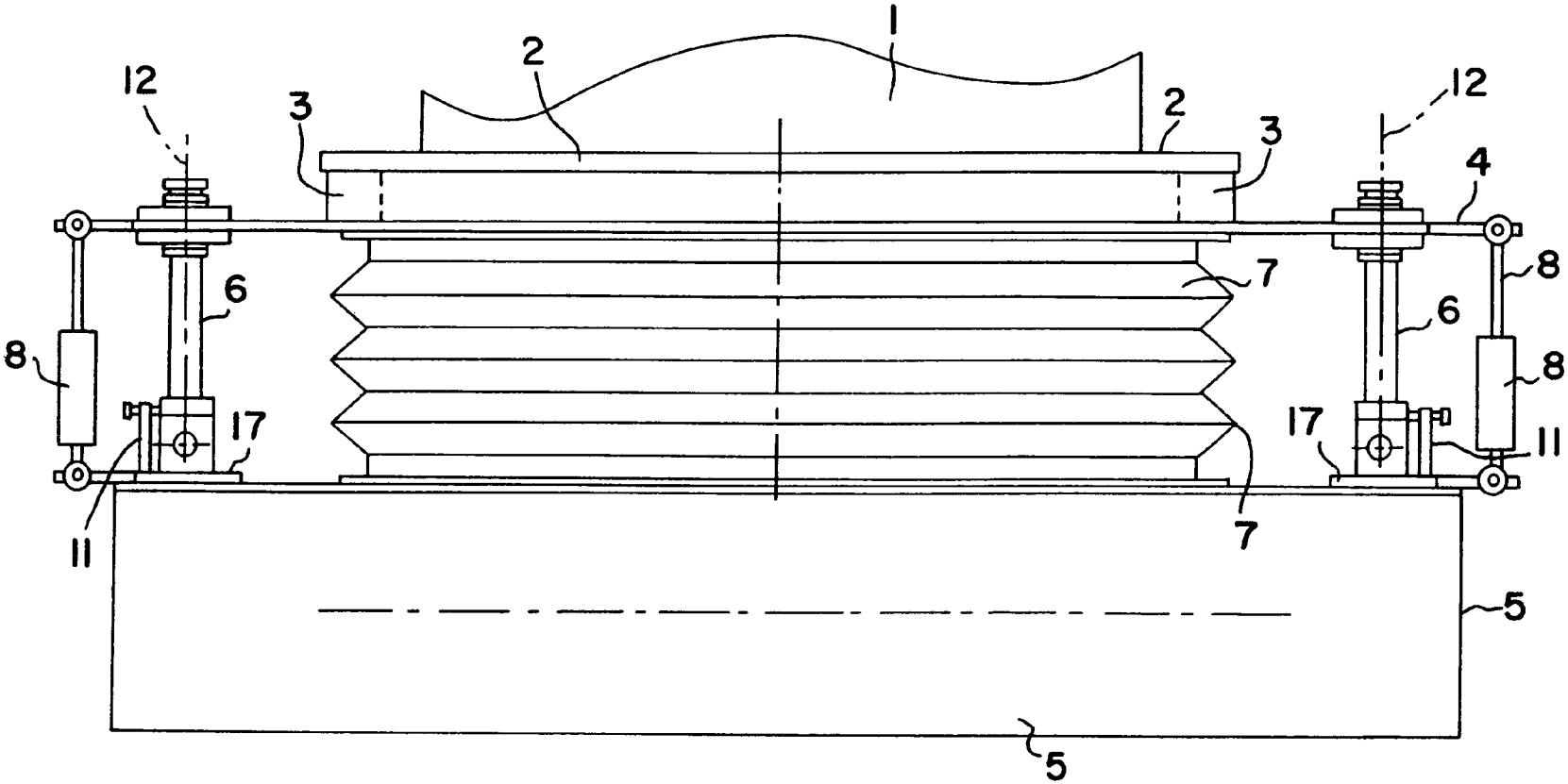
FIG. 1 is a top view of an embodiment of a multi-axis rotary seal system of the present invention installed at the end of a rotary tube and utilizing pneumatic cylinders to maintain a seal between a graphite ring and a rotary tube flange.
Figure 2:
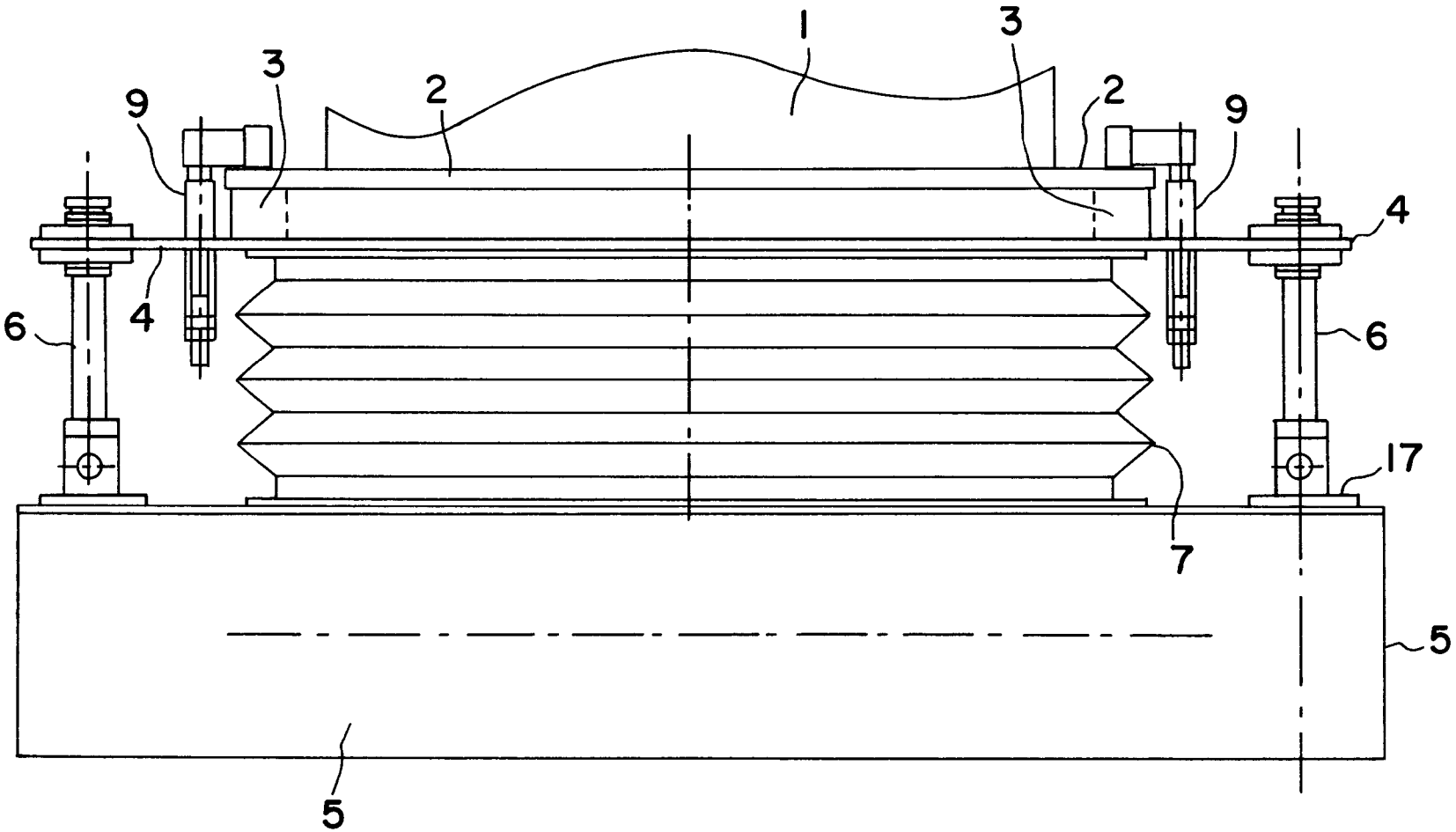
FIG. 2 is a top view of a spring and cam follower claim used in embodiments of the present invention and used to maintain a seal between a graphite ring and a rotary tube flange.
Figure 3:
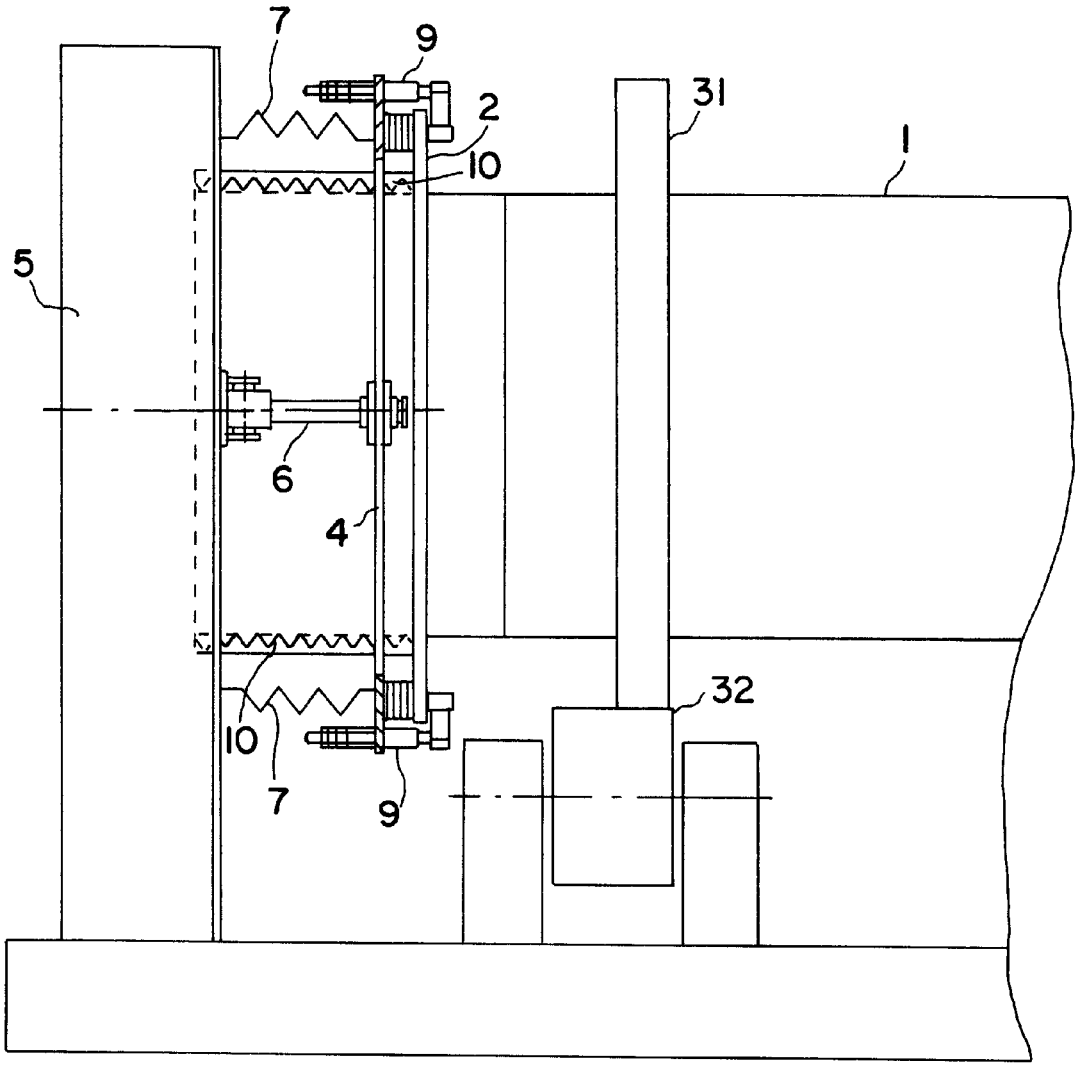
FIG. 3 is a side view of a multi-axis rotary seal system of embodiments of the present invention installed at an end of a rotary tube.

With reference to FIGS. 1–3, there is shown a top view (FIGS. 1 and 2) and side view (FIG. 3) of a multi-axis rotary seal system of embodiments of the invention installed at the exit end of rotary tube 1. Flange 2 on rotary tube 1 is slidably pressed against graphite ring 3 which is attached to structural ring 4. Structural ring 4 is attached to a stationary hood 5 by two multi-axis supports 6 positioned substantially 180 degrees apart and fastened to stationary hood 5 by means of bracket 17. Each support 6 is referred to as a multi-axis support since it allows movements both along and orthogonal to the central longitudinal axis 12 of the supports 6. Optionally, the bracket may include a stop means 11, which may be adjustable, to limit the degree of movement of the steel ring as shown in FIG. 1. The multi-axis support is set forth in greater detail in FIG. 4. In FIGS. 1–3, a fully flexible bellows 7 is attached at one end to the steel ring 4 and at the other end to the stationary hood 5. Bellows 7 may be secured to the ring 4 and the hood 5 by any of a variety of means such as bolts, clamps, and the like. In FIG. 1, the steel ring 4 (and the graphite sealing ring 3 attached thereto) are pressed against the flange 2 by, for example, pneumatic cylinders 8 as a constant pressure means to maintain a seal at the flange/graphite ring interface during rotation of the tube 1. A pneumatic cylinder 8 may be positioned adjacent each multi-axis support 6, as shown, for example, in FIG. 1. Additional pneumatic cylinders 8 can be employed at other positions around the ring 4, if desired.

In embodiments, such as that illustrated in FIG. 2, the constant pressure means used to maintain a seal between the graphite ring 3 and the flange 2 is a spring loaded clamping device including spring 26 and cam follower 21. Thus the seal at the flange/graphite ring interface, is maintained by clamping the steel ring 4 and the flange 2 together, pressing the graphite ring 3 against the flange 2.

With reference to FIG. 3, there is shown a side view of an embodiment of a multi-axis rotary seal system of the present invention installed at an end of the rotary tube 1. In the embodiment depicted, a thermal shroud 10 with insulation 11 covers the end of the rotary tube 1. The insulating thermal shroud 10 functions primarily to protect the flexible bellows 7 from exposure to excessive radiant heat from the tube 1. The use of such a thermal shroud or shield allows the fully flexible bellows employed in this embodiment of the invention to be comprised of a material with a relatively low temperature tolerance, such as rubber or plastic, or other flexible materials. Rotary tube 1 is rotatably supported in a known manner by metal tire 31 which rolls on roller trunion 32. Typically, at the other end of rotary tube 1 (not shown), rotary motion is provided by a drive means and geared trunion means.

Figure 4:
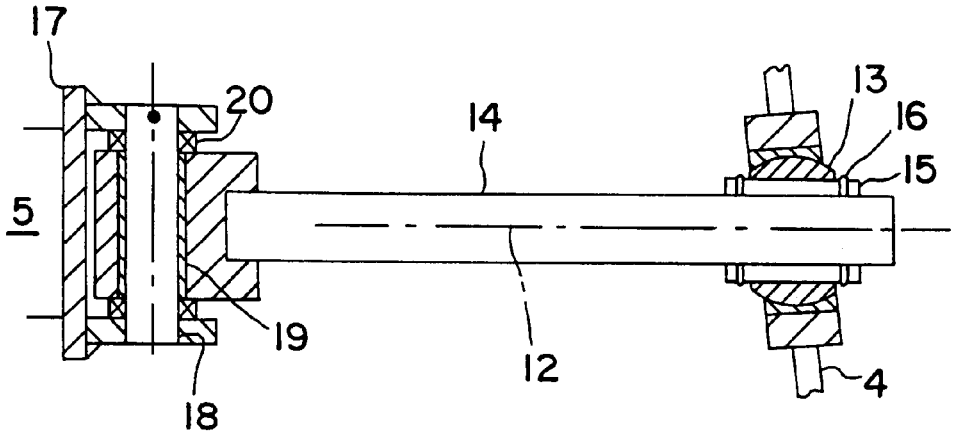
FIG. 4 is a cross-sectional view of a multi-axis support of embodiments of the present invention.

FIG. 4 illustrates a top view of an embodiment of a multi-axis support of the present invention. FIG. 4 is a cross-sectional view of one of the multi-axis supports 6 shown in FIGS. 1 and 2. The support 6 is attached to the hood 5 by bracket 17. A first shaft 18 is attached to the bracket. The longitudinal axis of the first shaft 18 lies substantially perpendicular to the longitudinal axis of a second shaft 14. Second shaft 14 is connected to the first shaft 18 at one end through a bushing 19 mounted around the first shaft. In embodiments of this invention, the second shaft 14 extends parallel to a longitudinal axis of a rotary tube kiln (not shown in FIG. 4). The bushing 19 allows limited rotation of the second shaft 14 about the longitudinal axis of the first shaft 18. A thrust bearing 20 connects the second shaft 14 to a flange of the first shaft 18. A spherical bearing 13 is mounted on the outside diameter of the second shaft 14 of each multi-axis support 6. Spherical bearing 13 supports structural ring 4 and allows structural ring 4 to rotate about an axis perpendicular to the plane defined by the longitudinal axes of the first and second shafts. In particular embodiments, spherical bearings 13 allow about 6° of tilt about a central longitudinal axis 12 of the horizontal shaft 14 of multi-axis support 6. However, it is expected that the amount of angular freedom will be increased or reduced as needed. A linear bearing 15 is located between the spherical bearing and the shaft 14. Linear bearing 15 allows linear movement along the central axis 12 of support 6. Two snap rings 16 are used to hold bearing 15 in place.

Figure 5:
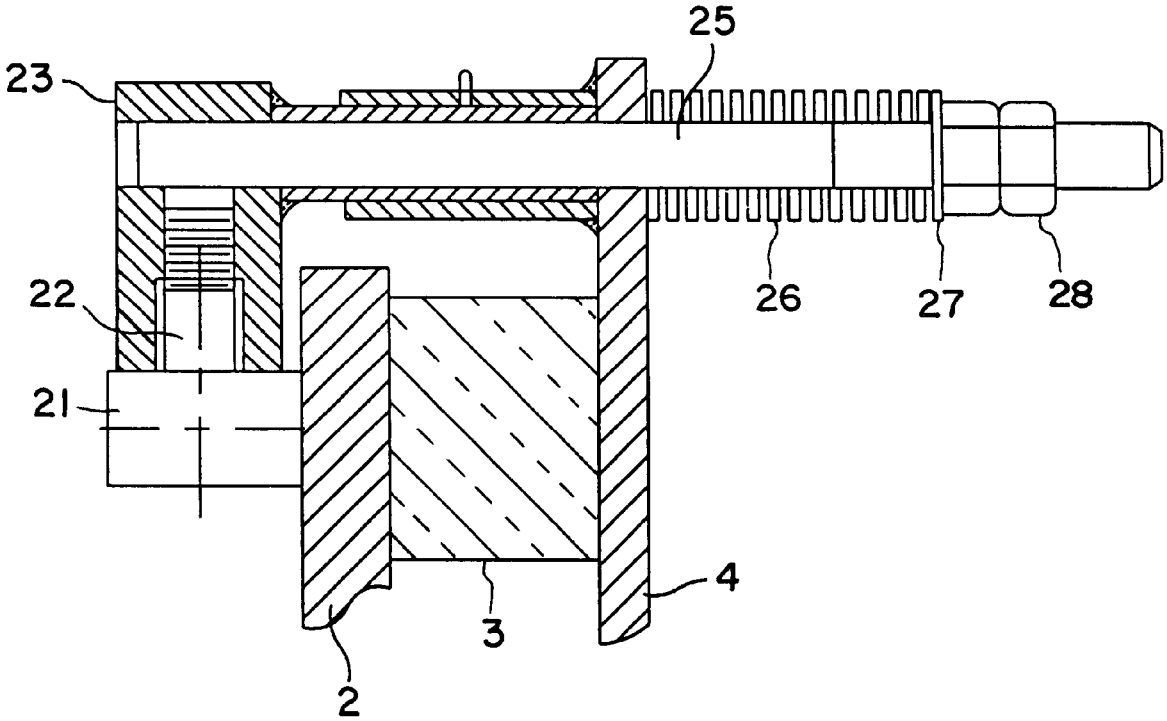
FIG. 5 is a side cross-sectional view of a spring and cam follower clamp of embodiments of the present invention installed at an end of a rotary tube.

FIG. 5 is represents a more detailed view of the spring and cam follower apparatus of the biasing device illustrated in FIG. 2. Rotatable cam follower 21 bears on a first surface of the tube mating flange 2. The second surface of the flange fixedly engages the graphite seal ring 3. An axle 22 of cam follower 21 is rotatably held in cam follower guide arm 23 which, in turn is attached to a connecting shaft 25. Compression spring 26 surrounds connecting shaft 25 and has a first end which bears on a first surface of steel structural ring 4. The second side of steel ring 4 fixedly engages graphite seal ring 3. The second end of spring 26 is in contact with washer 27. Nuts 28 hold washer 27 in place.

Although the invention has been described with reference to certain preferred embodiments, it will be appreciated by those skilled in the art that modifications and variations may be made without departing from the spirit and scope of the invention as defined in the appended claims.

What is claimed is:

1. A seal arrangement comprising:

a structural ring;

a multi-axis support attached to and supporting said structural ring to hold a seal ring in sealing engagement with an end of a rotary tube kiln;

a bellows having first and second ends, the first end attached to one of the structural ring and said seal ring, the second end attached to a stationary hood; and a biasing device applying force to said structural ring in a direction such that the structural ring biases the seal ring against the end of said rotary tube kiln.

2. A seal arrangement according to claim 1 wherein said multi-axis support comprises:

a bracket attached to said stationary hood;

a first shaft attached to said bracket, a longitudinal axis of said first shaft being substantially perpendicular to a longitudinal axis of said rotary tube kiln;

a second shaft connected to said first shaft at one end through a bushing mounted around said first shaft, said bushing allowing limited rotation of said second shaft about the longitudinal axis of said first shaft;

a linear bearing at another end of said second shaft;

a spherical bearing mounted about said linear bearing and supporting said structural ring.

3. A seal arrangement according to claim 1 wherein said biasing device comprises at least two pneumatic cylinders, each attached at one end to said structural ring and at another end to said stationary hood.

4. A seal arrangement according to claim 1, where the end of said rotary tube kiln includes a flange.

5. A seal arrangement according to claim 4, wherein said biasing device is a clamping device comprising:

a spring bearing on a surface of said structural ring;

a cam follower bearing on a surface of said flange; and a connecting shaft supporting said spring and said cam follower so that the said structural ring is biased toward said flange.

6. A seal arrangement according to claim 1 wherein said structural ring comprises steel.

7. A seal arrangement according to claim 1 wherein said stationary hood includes a thermal shroud that protects said bellows from heat.

8. A seal arrangement comprising:

a stationary hood;

a rotary tube kiln;

a seal ring slidably engaging an end of said rotary tube kiln;

a structural ring attached to said seal ring;

a bellows connected at one end to said stationary hood and at another end to said structural ring and seal ring; and a multi-axis support connected to and supporting said structural ring, seal ring, and bellows while allowing movement of said seal ring along an axis of said multi-axis support and about a plurality of mutually perpendicular axes while maintaining a tight seal between said seal ring and said end of said kiln tube.

9. A seal arrangement according to claim 8 wherein said multi-axis support comprises:

a first shaft attached to said stationary hood, a longitudinal axis of said first shaft being substantially perpendicular to a longitudinal axis of said rotary kiln tube; and a second shaft connected to said first shaft at one end through a bushing mounted around said first shaft, said bushing allowing limited rotation of said second shaft about said longitudinal axis of said first shaft.

10. A seal arrangement according to claim 9 wherein the multi-axis support further comprises a thrust bearing between one end of said second shaft and a flange of said first shaft.

11. A seal arrangement according to claim 9 wherein the multi-axis support further comprises:

a linear bearing at another end of said second shaft;

a spherical bearing mounted about said linear bearing and supporting said structural ring; and wherein said linear bearing allows movement of said structural ring along said second shaft and said spherical bearing allows movement of said structural ring about an axis substantially perpendicular to the longitudinal axes of both the first shaft and the second shaft.

12. The seal arrangement of claim 8 wherein the seal ring comprises graphite.

13. The seal arrangement of claim 8 wherein the structural ring comprises steel.

14. The seal arrangement of claim 8 wherein the bellows comprises an elastomeric material.

15. A seal arrangement comprising:

a stationary hood;

a rotary tube kiln;

a seal ring slidably engaging an end of the rotary tube kiln;

a structural ring attached to and supporting said seal ring;

a bellows connected at one end to the stationary hood and at another end to said structural ring;

a multi-axis support attached to and supporting said structural ring; and a biasing device applying force to the structural ring such that the seal ring engages the end of said rotary tube kiln, thereby maintaining a substantially gas-tight seal between the seal ring and the end of said rotary tube kiln during expansions and contractions and eccentricities of motion of said rotary tube kiln.

16. A seal arrangement in accordance with claim 15 wherein the biasing device comprises a pneumatic cylinder attached at one end to the structural ring and at another end to the stationary hood.

17. A seal arrangement in accordance with claim 15 further comprising a flange at the end of said rotary tube kiln and wherein the biasing device forces the flange and the seal ring toward each other.

18. A seal arrangement in accordance with claim 17 wherein the biasing device comprises:

a spring bearing on a surface of said structural ring opposite another surface of said structural ring that engages said seal ring;

a cam follower bearing on a surface of said flange opposite another surface of said flange that engages said seal ring; and a connector supporting the spring and the cam follower so that said structural ring is biased toward said flange, said structural ring thereby biasing said seal ring into engagement with said flange.

19. A seal arrangement in accordance with claim 15 wherein the seal ring comprises graphite.

20. A seal arrangement in accordance with claim 15 wherein the structural ring comprises steel.

21. A device for providing a seal between a rotating tubular kiln and a stationary component comprising:

a structural ring having attached thereto a seal ring;

a multi-axis support adapted at one end thereof for attachment to said stationary component and at another end thereof to be attached to and support said structural ring;

a flexible bellows adapted for attachment at one end to said stationary component and at another end to said structural ring; and a biasing device suitable for applying force to said structural ring in a direction such that said structural ring biases said seal ring against the end of said rotating tubular kiln.

22. A device in accordance with claim 21wherein said seal ring is graphite.

* * * * *